United States Patent [19]

Laakso

[11] Patent Number: 4,693,785

[45] Date of Patent: Sep. 15, 1987

[54] DIGESTER HAVING PLURAL SCREENS AND MEANS FOR CONTROLLING THE LIQUID WITHDRAWAL

[76] Inventor: Oliver A. Laakso, Haralyn West, #2 Middle Road, Smiths Parish, Bermuda, 3-18

[21] Appl. No.: 779,443

[22] Filed: Sep. 24, 1985

Related U.S. Application Data

[62] Division of Ser. No. 583,856, Feb. 27, 1984, Pat. No. 4,568,419.

[51] Int. Cl.[4] ..... D21C 3/26; D21C 7/14

[52] U.S. Cl. ..... 162/242; 162/246; 162/248; 162/251; 210/323.1

[58] Field of Search ..... 162/17, 19, 41, 42, 162/43, 44, 250, 251, 52, 60, 246, 248, 249, 57, 237, 242, 238; 8/156; 68/181 R; 210/194, 345, 806, 807, 323.1; 422/191, 193

[56] References Cited

U.S. PATENT DOCUMENTS

| | | | |
|---|---|---|---|
| 2,414,062 | 1/1947 | Richter | 162/249 |
| 2,695,232 | 11/1954 | Richter | 162/251 |
| 3,811,994 | 5/1974 | Ostberg | 162/250 |
| 4,193,839 | 3/1980 | Sherman | 162/251 |

FOREIGN PATENT DOCUMENTS

| | | | |
|---|---|---|---|
| 145249 | 2/1954 | Sweden | 162/249 |

*Primary Examiner*—Steve Alvo

*Attorney, Agent, or Firm*—Cushman, Darby & Cushman

[57] ABSTRACT

Comminuted cellulosic fibrous material, such as wood chips, are treated in a continuous digester to produce paper pulp or the like in a manner providing completely uniform treatment of the chips. The chips are introduced in a feed liquid slurry into the top of the digester having a plurality of annular screen systems each set vertically spaced from the other sets. At each screen set a plurality of nozzles are provided circumferentially spaced around the digester, each nozzle cooperating with only a particular radial segment of the screens. Withdrawal of liquid through the nozzles is practiced so that liquid is being withdrawn substantially through only one nozzle at a time, and it is being withdrawn at the same radial segment of the digester at each screen set at any particular point in time, with progressive switching in a circumferential sequence of the nozzles through which liquor is being withdrawn. Treatment liquors are introduced through a vertical conduit in the digester concentric with the digester shell, and discharge of treated chips (i.e. pulp) is provided at the bottom of the digester utilizing sluicing liquor and a rotating outlet which are designed to be substantially opposite the radial segment through which liquid withdrawal is being practiced at any particular time. The vertical conduit has a relatively large diameter so that treatment liquid is introduced with a relatively low velocity. A plurality of rotating valve elements and a common driven shaft preferably provide the mechanism for effecting liquid withdrawal in the desired sequence, and a rotatable shaft synchronized with the valve shaft provides for the introduction of sluicing liquid and positioning of the rotatable outlet.

7 Claims, 4 Drawing Figures

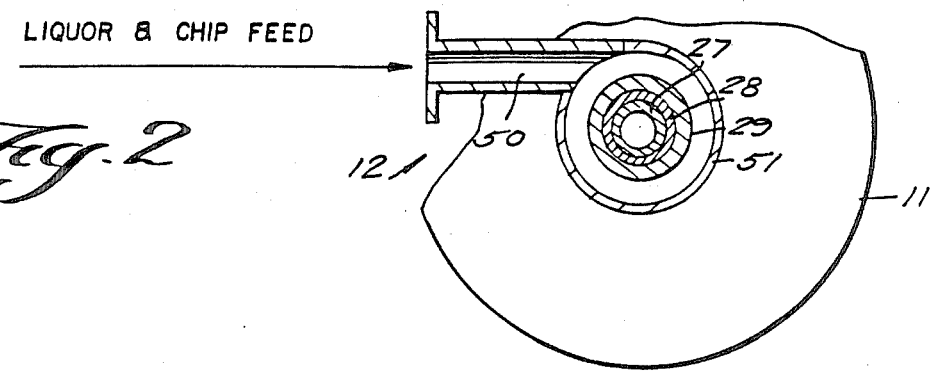
Fig. 2
Fig. 3
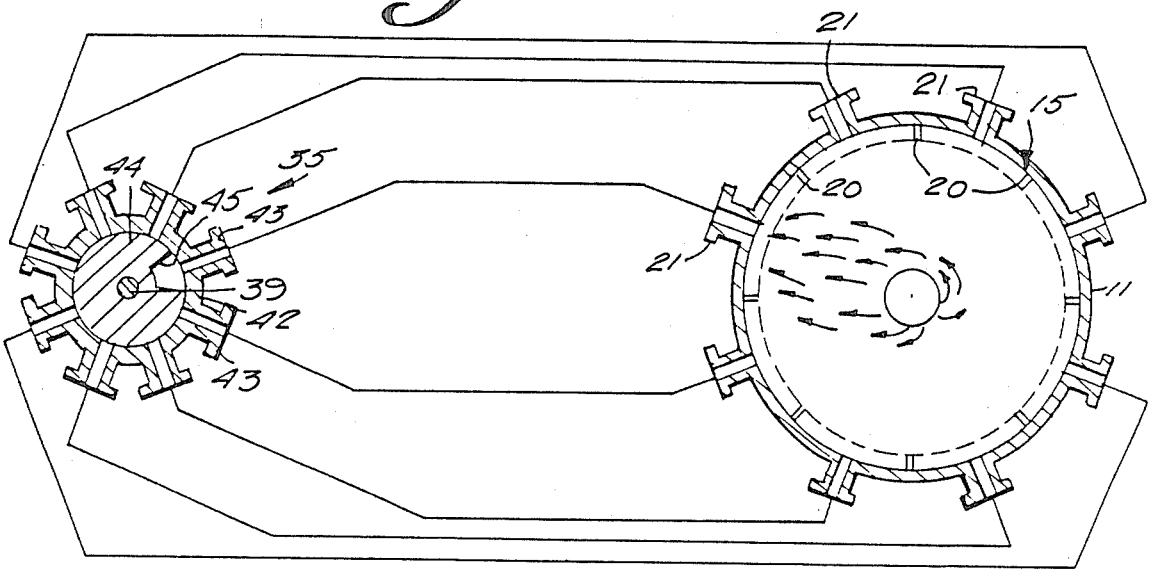
Fig. 4
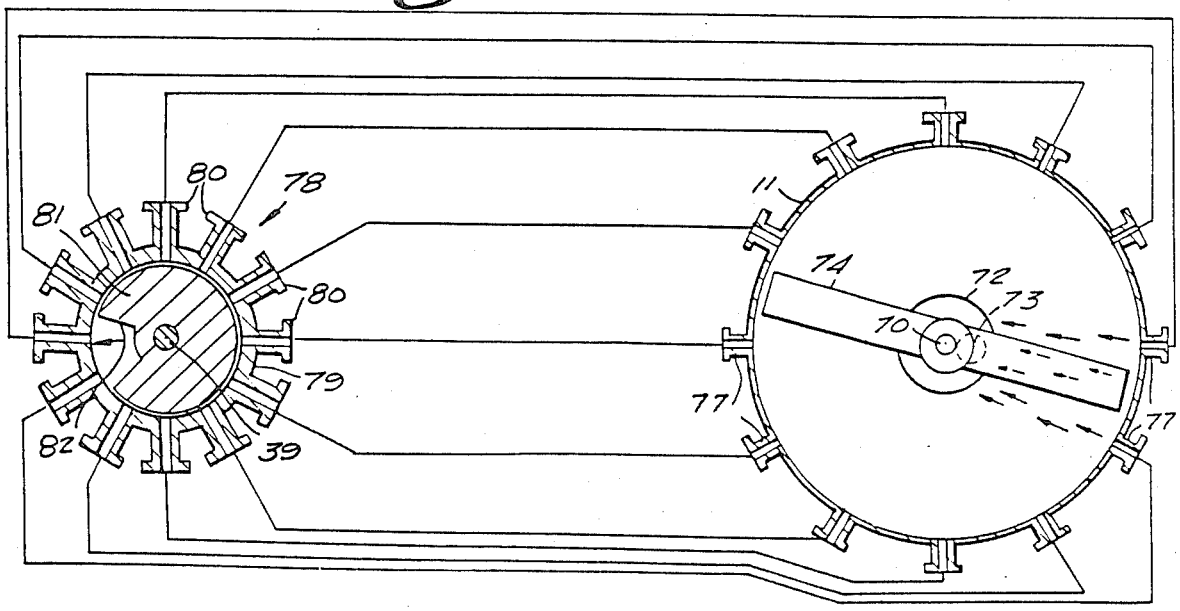

DIGESTER HAVING PLURAL SCREENS AND MEANS FOR CONTROLLING THE LIQUID WITHDRAWAL

This is a division, of application Ser. No. 583,856 filed Feb. 27, 1984, now U.S. Pat. No. 4,568,419.

BACKGROUND AND SUMMARY OF THE INVENTION

The invention relates to a continuous digester system, and method of treating comminuted cellulosic fibrous material, in order to achieve optimum uniformity of treatment and uniformity of material movement in the digester.

Conventional continuous digesters perform their designated functions quite well, in general. However a continuing practical problem in conventional continuous digesters is uniformity of treatment. Because of the variety of feed material and treatment liquids, and the enormous size of modern continuous digesters, it is not unusual to experience uniformity problems. Some parts of the material column may fail to move properly through the digester with resultant nonuniformity of treatment of the material, and improper liquid flows in some parts of the column also introduce undesirable variations in the treatment of the material. Nonuniformity of the pulp discharged from the digester can, of course, adversely affect subsequent treatment stages, and the quality of the end product produced. Therefore it is highly desirable to effect treatment that is as uniform as possible.

According to the present invention, several radical departures are made vis-a-vis conventional continuous digesters, with a view toward increasing uniformity of treatment. In conventional continuous digesters, feed liquor is separated from the introduced wood chips (or like comminuted cellulosic fibrous material such as bagasse, agricultural wastes, etc.) at the top of the digester, above the level of the chips column formed in the digester. The chips column that does form has a generally conical taper at the top thereof. Treatment liquors that are introduced into the digester move with relatively high velocity through the chips in order to minimize possibility of screen clogging, and every effort is made to minimize channeling since if channeling occurs—especially with relatively high treatment liquor velocities—significant nonuniformity of treatment results.

The digester, and method of treatment of wood chips, according to the present invention differ in every aspect from the conventional practice as described above. For instance according to the present invention, separation of feed liquor from the chips does not occur at the top of the vessel, but rather below the top of the chips column. The chips entrained in feed liquor are introduced substantially horizontally into the top of the vessel, with a swirling action, and result in the establishment of a chip column having a generally horizontal top surface. Such a top surface—compared to the conical top surface that normally is produced in conventional practice—lends itself to much more uniform treatment of the chips, fewer hang ups, and the like. Withdrawal of feed liquid takes place below the top of the chips column, utilizing withdrawal screens. Treatment liquids introduced into the digester are introduced utilizing a vertically extending conduit concentric with the digester which has a relatively large diameter, resulting in the introduced liquids having a relative low velocity. Sets of vertically spaced withdrawal screens in the digester, which provide for recirculation of the treatment liquids and the like, are operated in such a manner that channeling is deliberately introduced into the chip column, the channeling action progressively moving around the circumference of the digester so that it is practiced in circumferentially consecutive radial segments of the digester.

The practice of the method according to the present invention is accomplished by providing a plurality (preferably at least three, and normally more) sets of vertically spaced screen systems in the digester. For each screen system a plurality (preferably at least four, and normally more) liquid withdrawal nozzles are provided circumferentially spaced from each other, with each nozzle cooperating with only a particular radial segment of the screens to facilitate withdrawal of liquid through that radial segment only. The radial segment of the various screen sets are generally vertically aligned, and withdrawal through the nozzles is practiced so that liquid is being withdrawn from the same radial segment of each screen set at the same time. Such withdrawal is preferably accomplished utilizing a plurality of rotary valves operated by a common shaft operator, each valve being connected to the withdrawal nozzles associated with each screen set.

At the bottom of the digester a discharge mechanism is provided for discharging cooked, quenched, and washed pulp. The discharge mechanism preferably comprises a rotating scraper operatively connected to a rotating outlet, and sluicing liquid is introduced into the bottom of the digester at substantially the same radial segment as the rotating outlet, the sluicing liquid entraining pulp and flushing it through the outlet, so that it is discharged from the digester. The introduction of sluicing liquid, and the rotation of the outlet and scraper, are synchronized with respect to the treatment liquid withdrawal so that discharge of pulp is always taking place at a radial segment of the digester approximately opposite to the radial segment at which liquid withdrawal is taking place. A rotary valve connected to the same shaft as the withdrawal liquid valves preferably provides for the synchronized introduction of the sluicing liquid.

A wide variety of chips treatments may be practiced according to the present invention, but usually the chips would be impregnated, cooked, quenched, and then washed in the continuous digester according to the invention, and in the practice of the method according to the invention.

It is the primary object of the present invention to provide a continuous digester, and a method of treating wood chips (or other comminuted cellulosic fibrous material), that optimize the uniformity of treatment. This and other objects of the invention will become clear from an inspection of the detailed description of the drawings, and from the appended claims.

BRIEF DESCRIPTION OF THE DRAWINGS

FIG. 2 is a cross-sectional view taken along lines 2—2 of FIG. 1;

FIG. 3 is a cross-sectional view taken along lines 3—3 of FIG. 1, the cross-sectional views taken along lines 5—5, 6—6 and 7—7 of FIG. 1 being substantially identical; and FIG. 4 is a cross-sectional view taken along lines 4—4 of FIG. 1.

DETAILED DESCRIPTION OF THE DRAWINGS

Figure 1:
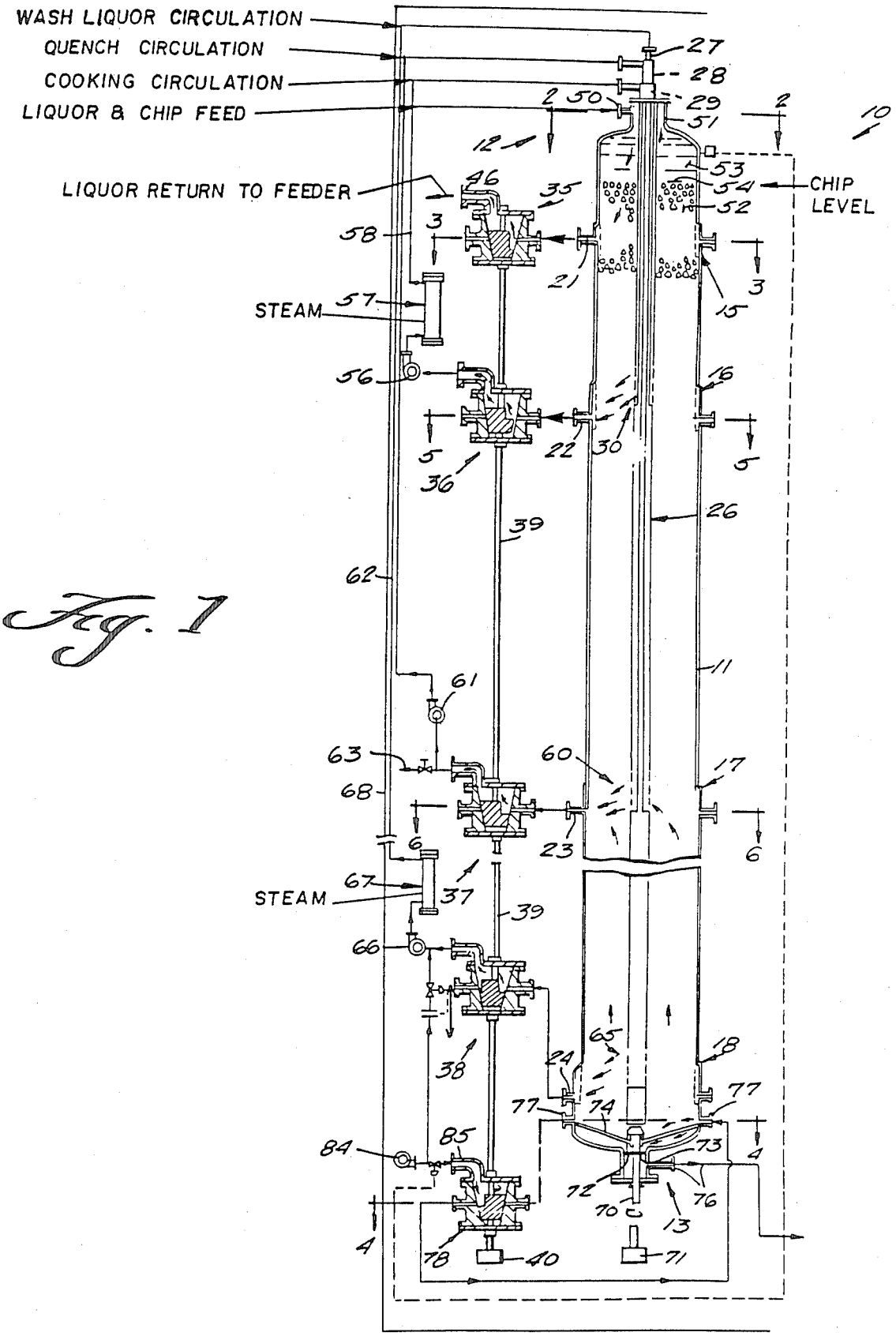
FIG. 1 is a side schematic view, partly in cross-section and partly in elevation, of an exemplary continuous digester system according to the present invention.

The invention is primarily applicable to the treatment of comminuted cellulosic fibrous material, such as wood chips, bagasse, agricultural waste, and the like. While the invention will be described herein with particular reference to the treatment of wood chips, it is to be understood that it is equally applicable to other comminuted cellulosic fibrous materials.

An exemplary continuous digester system according to the present invention is shown generally by refence numeral 10 in FIG. 1. The main component of the system 10 comprises the vertical digester vessel 11. At the top of the vessel 11 is mean 12 for introducing chips entrained in feed liquor, and at the bottom is a means 13 for discharging treated material (i.e. pulp).

Associated with a vessel 11 are a plurality of sets of annular withdrawal screens, the screens themselves being conventional, such as shown in U.S. Pat. No. 3,811,994. Preferably at least three sets of vertically spaced withdrawal screen systems are provided, and usually more, depending upon the particular treatments that are to be effected in the vessel 11. In the example of the invention illustrated in FIG. 1, four vertically spaced annular screen sets are provided, sets 15, 16, 17, and 18.

As perhaps can best be seen in FIG. 3, for the screen set 15, each annular screen set is divided into a plurality of radial segments by dividing walls 20. Associated with each radial segment, defined by dividing walls 20, is a liquid withdrawal nozzle 21. In the embodiment illustrated in the drawings, eight nozzles 21 are shown associated with the screen set 15, each nozzle 21 thus being associated with a radial segment of approximately 45° (i.e. 360° divided by eight), however it is to be understood that any number of nozzles, and associated radial segments, may be provided. Best results are obtained, however, when there are at least four withdrawal nozzles 21, and associated radial segments (i.e. radial segments of about 90° or less).

With the screen sets 16, 17, and 18, respectively, there are provided the outlet nozzles numerals 22, 23, and 24, respectively. The nozzles 21–24 for all of the screen sets—or at least the radial segment to which they relate—will all preferably be vertically aligned. Thus cross-sectional views of the system 10 taken along lines 5—5, 6—6, and 7—7 of FIG. 1 will be essentially identical to the cross-sectional view of FIG. 3 (except that the vessel 11 is slightly larger in diameter as one moves from the screen set 15 to the screen set 18; e.g. the vessel diameter is 18 feet at screen set 15, and 22 feet at screen set 18).

Treatment liqour is introduced into the vessel 11 utilizing the central conduit 26, which is a vertical conduit substantially concentric with the vessel 11, and including a number of concentric pipes, such as the wash liquor pipe 27, the quench liquor pipe 28, and the cooking liquor pipe 29. In order that the velocity of the introduced liquors be relatively low (e.g. about 0.65 feet per second at area 30 where the cooking liquor pipe 29 introduces cooking liquor into the vessel 11), the diameter of the conduit 26 is relatively large. For instance the diameter of the conduit 26 would be at least about 0.18 of the diameter of the vessel 11. For a vessel 11 wherein the internal diameter ranges from about 18 feet at the screens 15, to about 22 feet at the screens 18, the diameter of the conduit 26 (which would remain substantially constant throughout its entire length) will preferably between about 4–5 feet.

Liquid withdrawal means are associated with each of the withdrawal screens 15–18 for effecting withdrawal of the liquid, and for deliberately introducing channeling of liquid flow through predetermined radial segments of the vessel 11. Such withdrawal means include valve means operatively connected to the nozzles 21–24 and means for operating the valve means so that the liquid is withdrawn from substantially the same radial segment of the vessel 11 at each of the withdrawal screens 15–18 at the same time, and so that the radial segment through which withdrawal takes place is progressively switched in a circumferential sequence, to prevent clogging of the screens and to facilitate uniformity of treatment. In the exemplary embodiment of the invention illustrated in the drawings, the valve means comprise rotary valve assemblies 35, 36, 37, and 38, which are associated with the screens 15–18 respectively. The means for operating the valve means 35–38 preferably comprises a common vertical shaft 39 which is driven by a power source 40.

Each of the valve means 35–38 are substantially the same. The valve means 35—which is seen most clearly in FIGS. 1 and 3—comprises a valve body 42 having a plurality of inlets 43, one inlet for each nozzle 21, the inlets 43 being connected to the nozzles 21 in the same circumferential sequence, as illustrated in FIG. 3. The valve means 42 further comprises a rotating valve element 44 which comprises a substantially solid plug having a cutout 45 formed therein, the cutout 45 having an arcuate extent which is essentially the same as (or slightly greater than) a radial segment defined by the dividing walls 20. For the embodiment illustrated in the drawings, the cutout 45 would thus have an arcuate extent of a little more than 45°. The valve means 35 also comprises an outlet 46, liquid entering the cutout 45 through a particular inlet 43 passing to the outlet 46, while liquid at all the other inlets 43 is blocked by the rotating valve plug 44.

The chips and liquor introduction device 12 introduces chips entrained in liquid in such a way that—in combination with the screen set 15 and the valve 35—a chip column having a substantially horizontal top, facilitating uniform treatment of the chips, is produced. The introduction device 12 comprises an inlet conduit 50 which is substantially horizontal, introducing the chips entrained in liquid in a substantially horizontal manner. Also, the inlet 50 is located tangentially with respect to the topmost portion 51 of the vessel 11, and this tangential location, combined with the fact that the vertical conduit 29 extends in this area, results in a swirling action of the chips entrained in liquid, the chips ultimately being deposited evenly in the chips column 52 (see FIG. 1) formed in the vessel. The chip level is sensed by any conventional means, and is maintained so that there is a liquid volume 53 thereabove, by controlling the feed into the inlet 50. The horizontal top surface 54 of the chips column 52 is in contradistinction to the conically shaped top of the chip column that exists in the prior art.

Also in contradistinction to the prior art, the feed liquid withdrawal means according to the invention comprises the first screen system 15 which is actually in contact with the chips in column 52, below the level of the top 54. Feed liquor withdrawn through valve means 35 and discharged from conduit 46 thereof ultimately passes back to the conventional high pressure feeder for feeding chips to the means 12.

While particular treatment stages in the vessel 11 will be dependent upon the particular raw material utilized, and the particular results desired, typically impregnation would take place in the upper part of the chips column, while cooking liquor is introduced through conduit 29 within central conduit structure 26 at point 30. The cooking liquor which is recirculated through the valve means 36 under the influence of pump 56 is heated by conventional indirect steam heating means 57, and returned by a line 58. Additional cooking liquor can be added to this line when desired.

While FIG. 1 illustrates a single cooking circulation screen and heater, as is known in the art per se two or more screens and heaters could be provided to effect the temperature rise produced utilizing the cooking liquor in two or more stages. Any additional screen sets would be substantially identical to the screen set 16, having a cooperating valve like the valve 36.

Adjacent the screen set 17, quench liquid is introduced at point 60, the withdrawn liquid passing through valve means 37 under the influence of pump 61 being returned via line 62 to the quench circulation vertical conduit 28. Through screen 17, as illustrated schematically in FIG. 1, spent wash liquor, which moves countercurrent to the downward movement of the chips column, is also removed, and some of the volume of the liquid passing through valve means 37 is extracted in conduit 63.

Just above the bottom of the vessel 11 is where the wash liquor introduction conduit 27 introduces liquid, as illustrated at 65. Liquid withdrawn through valve 38 under the influence of pump 66 is heated by indirect steam heating means 67, and returned via conduit 68 to the vertical conduit 27. Wash liquor, as described above, flows upwardly in the bottom third of the vessel 11, countercurrent to the chips column flow.

The pulp discharge means 13 can best be seen with respect to FIGS. 1 and 4. The means 13 includes a vertical shaft 70 substantially concentric with the vessel 11, and driven by power source 71. Attached to the shaft 70 is a rotating plate 72 which has an outlet opening 73 therein. Also preferably attached to the shaft 70 is a rotating scraper 74. The scraper breaks up the bottom of the cooked chips column to facilitate the blowing of the cooked chips from the digester 11 to subsequent treatment systems, such as a further washing stage.

The discharge means 13 also comprises means for introducing sluicing liquid at the very bottom of vessel 11, for entraining the pulp and moving it outwardly through the nozzle 73, and ultimately into discharge conduit 76. The sluicing liquid introduction means preferably comprises a plurality of introduction nozzles 77 circumferentially spaced along the periphery of the vessel 11 at the bottom thereof. In the exemplary embodiment illustrated in FIG. 4, twelve such nozzles 77 are provided. It is desired that the number of nozzles 77 be greater than the number of the nozzles associated with each set of screens 15-18. Operatively connected to the inlet nozzles 77 is the valve means 78.

Valve means 78 comprises a valve body 79 having a number of inlet nozzles 80, the number of nozzles 80 corresponding to, and being connected with in the same sequence, inlet nozzles 77 to the bottom of the vessel 11. Mounted within the body 79, connected to shaft 39 and for rotation with respect to body 79, is the valve plug 81 which has a radial segment cutout 82. Preferably the arcuate extent of the radial segment cutout 82 is slightly greater than the arcuate extent of any of the radial segments associated with the screen sets 15–18, and preferably the arcuate extent of the cutout 82 corresponds to approximately the arcuate distance between a pair of inlet nozzles 77 so that sluicing liquid is being introduced through two adjacent inlet nozzles 77 at any one time. In the exemplary embodiment illustrated in FIG. 4, the cutout 82 has an arcuate extent of slightly more than 60°. Spent wash liquid (e.g. from line 63) is pumped via pump 84 into the inlet conduit 85 of valve means 78, flows through the cutout 82 in the plug 81, and passes through the nozzles 80 in alignment with the cutout 82 at that particular point in time.

According to the present invention, the location of the cut out 82 in the valve plug 81 is essentially opposite the cutout 45 in the valve plug 44 (and opposite the corresponding cutouts in the valve plugs associated with valve means 36–38). Also, the outlet opening 73 in rotating disk 72 is in alignment with the inlets 77 through which liquor is being introduced at any particular point in time, and thus the outlet 73 is substantially opposite the radial segment through which liquor is being withdrawn by the screens 15–18 at any particular point in time. Rotation of the shafts 39, 70, is synchronized by any suitable synchronization means, such as a timing chain. Typically the shafts 39 and 70 would rotate at about 2–5 rpm.

In the practice of the method according to the invention, the types and temperatures of the treatment liquids, and the pressure within the vessel 11, would be essentially the same as in conventional digesters, depending upon the throughput, type of raw material, and desired pulp to be produced.

Operation

Exemplary apparatus according to the invention having been described, an exemplary operation thereof to practice the method according to the present invention will now be described.

Chips entrained in feed liquor are introduced into inlet 50 of mechanism 12, generally horizontally with a swirling action imparted thereto, and establish a substantially horizontal top surface 54 of a vertical chips column 52 in the vessel 11. The discharge of pulp through means 13 is coordinated with the feed through means 12 to produce a top surface 54 of the chips column 52 just below the top of the vessel, so that a liquid volume 53 exists, with each segment of chips moving downwardly through the vessel 11.

Feed liquid is withdrawn through screen set 15 and valve means 35, and returned via line 46 to the high pressure feeder to be recirculated back to inlet 50. Cooking, quenching, and washing take place at lower stages in the vessel 11, the various treatment liquids being introduced through central conduit 56 at points 30, 60, and 65, and the introduced liquids having a relatively small velocity due to the relatively large size of the central conduit 26 with respect to the digester shell 11. The various circulation loops are established utilizing the valves 36–38, and connected pumps, heaters, and the like, and the withdrawal of liquids for recirculation is practiced so that withdrawal is taking place for the same vertically aligned radial segments (e.g. 45°) associated with each of the screen sets 15–18.

Essentially opposite the radial segments through which liquid is being withdrawn through the screen sets 15 through 18, sluicing liquid is being introduced through nozzles 77, to entrain pulp and flush it through the outlet 73, which also is essentially opposite the radial segment through which liquid is being withdrawn. The scraper 74 assists in this discharge action, and the treated pulp is ultimately discharged into conduit 76, to be passed to subsequent treatment stations (such as washing, storage, and bleaching stations).

It will thus be seen that according to the present invention a method and apparatus have been provided for the uniform treatment of comminuted cellulosic fibrous material. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Digester for treating comminuted cellulosic material in suspension, comprising:

(a) a vertical vessel;

(b) means for introducing material entrained in liquid at the top of the vessel;

(c) means for discharging treated material at the bottom of the vessel;

(d) a plurality of sets of annular screen systems, each set vertically spaced from the other sets;

(e) at least four circumferentially spaced outlet nozzles associated with each screen set, each outlet nozzle operatively connected to a particular radial segment of the screen set with which it is associated and for withdrawing liquid only through radial segment, and radial segments of the various screen sets being substantially vertically aligned;

(f) withdrawal means for withdrawing liquid from through each of said screen sets, said withdrawal means including: (g) valve means operatively connected to each of said nozzles associated with each of said screen systems; and (h) means for controlling operation of said valve means so that liquid is withdrawn through the nozzles associated with vertically aligned radial segments of all of said screen sets at the same time, while no significant amount of liquid is withdrawn through the other nozzles associated with the screen sets at that time;

(i) a vertically extending central conduit disposed in said vessel for introducing treatment liquid into said vessel adjacent central points of said vessel, said conduit being substantially concentric with said vessel;

said valve means comprising, a plurality of valve members, a said valve member being associated with each screen set, each said valve member comprising a single valve body, an inlet to said valve body associated with each of said nozzles, a single rotary valve element mounted for rotation within said body, and a single outlet from said body and wherein said means for controlling operation of said valve means comprises a common operating member interconnecting each of said rotary valve elements and a drive mechanism for effecting movement of said common drive member.

2. Digester for treating comminuted to cellulosic material in suspension, comprising:

(a) a vertical vessel;

(b) means for introducing material entrained in liquid at the top of the vessel;

(c) means for discharging treated material at the bottom of the vessel;

(d) a plurality of sets of annular screen systems, each set vertically spaced from the other sets;

(e) at least four circumferentially spaced outlet nozzles associated with each screen set, each outlet nozzle operatively connected to a particular radial segment of the screen set with which it is associated and for withdrawing liquid only through said radial segment, and the radial segments of the various screen sets being substantially vertically aligned;

(f) withdrawal means for withdrawing liquid from through each of said screen sets, said withdrawal means including: (g) valve means operatively connected to each of said nozzles associated with each of said screen systems; and (h) means for controlling operation of said valve means so that liquid is withdrawn through the nozzles associated with vertically aligned radial segments of all of said screen sets at the same time, while no significant amount of liquid is withdrawn through the other nozzles associated with the screen sets at that time; and (i) a vertically extending central conduit disposed in said vessel for introducing treatment liquid into said vessel adjacent central points of said vessel, said conduit being substantially concentric with said vessel; and said plurality of screen sets comprising at least three screen sets;

said valve means comprising, associated with each screen set: a single valve body; an inlet to said valve body associated with each of said nozzles; a single rotary valve element mounted for rotation within said body; and a single outlet from said body; and wherein said means for operating said valve means comprises a common shaft interconnecting each of said rotary valve elements, and a valve mechanism for effecting rotation of said common shaft.

3. Apparatus as recited in claim 2 or 1 wherein said means (c) comprises (c1) means for introducing sluicing liquid at the bottom of said vessel, including a plurality of circumferentially spaced sluicing liquid introduction nozzles disposed around the circumference of the vessel at the bottom thereof for introducing sluicing liquid at a particular radial segment of the vessel; (c2) an outlet means mounted for rotation about a vertical axis concentric with said vessel, at the bottom of said vessel; (c3) valve means for preventing or allowing the flow of sluicing liquid into said inlet nozzle; and (c4) means for operating said valve means and said rotatable outlet means so that sluicing liquid is introduced into, and said outlet is at, a particular radial segment of said vessel approximately opposite the radial segment at which liquid is being withdrawn by said structures (f), (g) and (h).

4. Apparatus as recited in claim 3 wherein said discharge means further comprises a scraper at the bottom of said vessel, rotatable with said rotatable outlet means.

5. Apparatus as recited in claim 2 or 1 wherein said means (c) comprises a scraper and an outlet mechanism disposed at the bottom of said vessel; and means for effecting rotation of said scraper and outlet mechanism about a vertical axis substantially concentric with said vessel; and further comprising means for synchronizing rotation of said rotary valve elements, and rotation of said scraper and rotatable outlet.

6. Apparatus as recited in claim 2 or 1 wherein said structure (i) comprises a conduit having a diameter which is at least about .18 as large as the internal diameter of the vessel, so that the velocity of introduced liquid within the vessel is relatively small.

7. Apparatus as recited in claim 2 or 1 wherein said means (c) comprises (c1) means for introducing sluicing liquid at the bottom of said vessel, including a plurality of circumferentially spaced sluicing liquid introduction nozzles disposed around the circumference of the vessel at the bottom thereof for introducing sluicing liquid at a particular radial segment of the vessel; (c2) an outlet means mounted for rotation about a vertical axis concentric with said vessel, at the bottom of said vessel; (c3) valve means for preventing or allowing flow of sluicing liquid into said inlet nozzle; and (c4) means for operating said valve means and said rotatable outlet means so that sluicing liquid is introduced into, and said outlet is at, a particular radial segment of said vessel approximately opposite the radial segment at which liquid is being withdrawn by said structures (f), (g) and (h).

* * * * *